United States Patent [19]

Davison

[11] Patent Number: 4,736,204

[45] Date of Patent: Apr. 5, 1988

[54] METHOD AND APPARATUS FOR COMMUNICATING WITH DOWNHOLE MEASUREMENT-WHILE-DRILLING EQUIPMENT WHEN SAID EQUIPMENT IS ON THE SURFACE

[75] Inventor: Francis L. Davison, Houston, Tex.

[73] Assignee: NL Industries, Inc., New York, N.Y.

[21] Appl. No.: 948,020

[22] Filed: Dec. 31, 1986

Related U.S. Application Data

[63] Continuation of Ser. No. 774,144, Sep. 9, 1985.

[51] Int. Cl.[4] ..... G01V 1/00

[52] U.S. Cl. ..... 340/856; 340/857; 340/854; 175/40

[58] Field of Search ..... 340/854, 855, 853, 856; 367/25, 911; 181/102; 166/250; 175/40

[56] References Cited

U.S. PATENT DOCUMENTS

| | | | |
|---|---|---|---|
| 2,349,366 | 5/1944 | Moon | 250/254 |
| 2,411,696 | 11/1946 | Silverman et al. | 177/352 |
| 3,186,222 | 6/1965 | Martin | 73/151 |
| 3,315,224 | 4/1967 | Ferguson | 340/853 |
| 4,015,234 | 3/1977 | Krebs | 367/81 |
| 4,033,186 | 7/1977 | Bresie | 73/154 |
| 4,087,781 | 5/1978 | Grossi et al. | 340/854 |
| 4,468,665 | 8/1984 | Thawley et al. | 340/856 |
| 4,527,148 | 7/1985 | Kuboki et al. | 367/65 |

*Primary Examiner*—Charles T. Jordan
*Assistant Examiner*—John W. Eldred
*Attorney, Agent, or Firm*—Browning, Bushman, Zamecki & Anderson

[57] ABSTRACT

Communication with a measuring-while-drilling equipment sub, when the sub is at the surface, is established by placing a transmitter-receiver within transmitting range of the electrode/antenna array of the sub. The transmitter-receiver must be compatible with the sub equipment and be capable of transmitting to the sub instructions to dump the sub memory and/or add data to the sub memory.

8 Claims, 1 Drawing Sheet

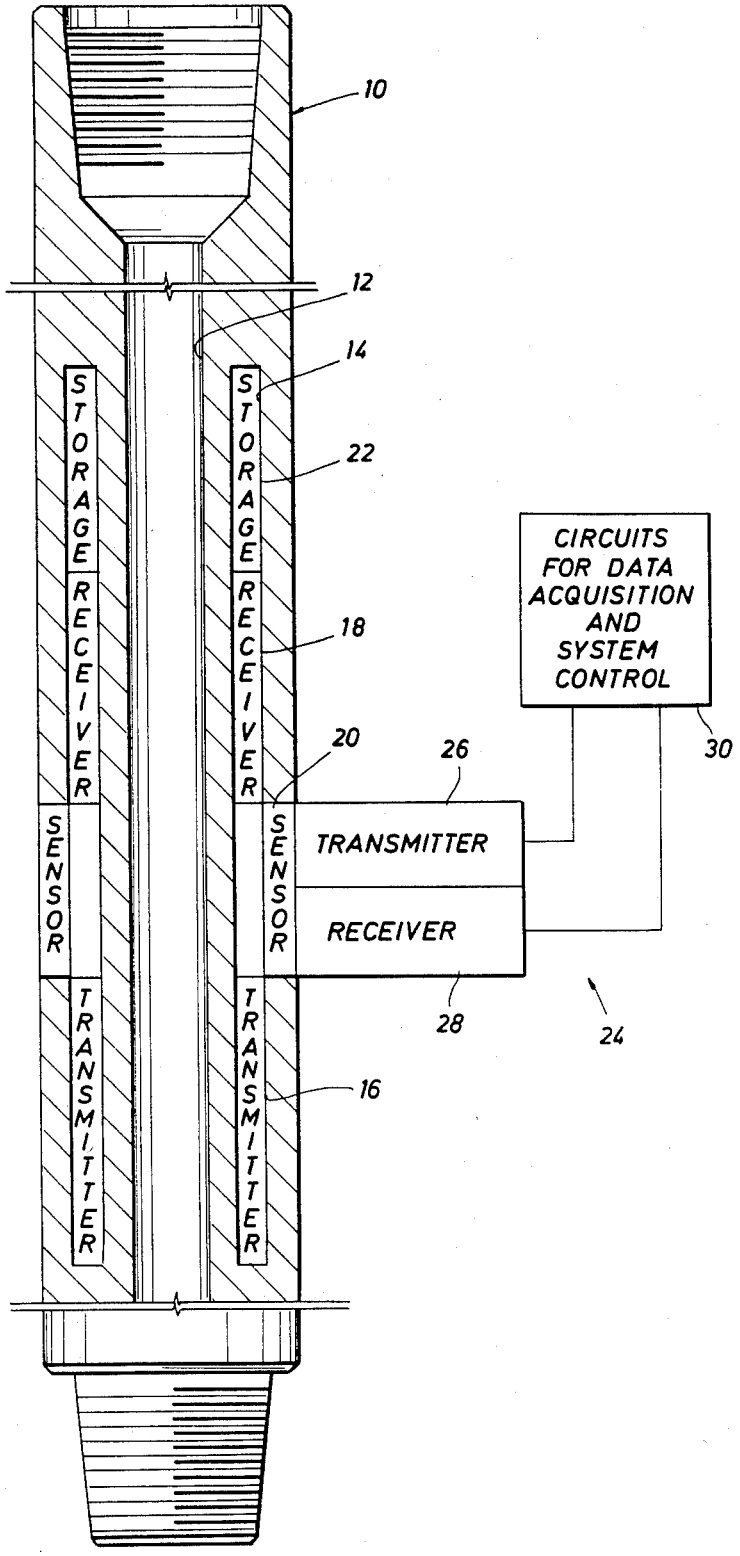
10
12
14
22
18
20
26
30
28
24
16
STORAGE
RECEIVER
SENSOR
TRANSMITTER
STORAGE
RECEIVER
SENSOR
TRANSMITTER
CIRCUITS FOR DATA ACQUISITION AND SYSTEM CONTROL
TRANSMITTER
RECEIVER

METHOD AND APPARATUS FOR COMMUNICATING WITH DOWNHOLE MEASUREMENT-WHILE-DRILLING EQUIPMENT WHEN SAID EQUIPMENT IS ON THE SURFACE

This is a continuation of application Ser. No. 774,144, filed Sept. 9, 1985.

BACKGROUND OF THE INVENTION

The present invention is directed to a method and apparatus which is used in conjunction with conventional downhole measurement-while-drilling equipment to establish communication therewith while the equipment sub is on the surface.

Recent developments in the area of measurement-while-drilling equipment has produced sufficient technological changes in that the downhole equipment is able to accumulate a substantial amount of information, such as detailed descriptions of the various strata through which the drill is passing. Much of this information is extremely important, but not essential to the on-going drilling operation. The drilling operation would require all of the details of the drill bit orientation, so as to correct the advancing boring operation and would be less concerned with the actual strata being penetrated. Thus, the usual telemetry that is provided, either with a mud pulsing system or hard wired system would give priority to the boring information and store the more detailed information concerning the various strata. Other known downhole equipment only records formation data for subsequent recovery and evaluation. It is then possible to recover any stored information when the downhole equipment is periodically returned to the surface for bit replacement.

Prior systems for recovery of the stored data have employed direct electrical connections, which require an aperture to be formed in the wall of the downhole equipment sub. Having an aperture in the wall of the sub creates the problem of weakening the structure creating the possibility of fracturing the sub with the possible resulting loss of the downhole equipment requiring an expensive fishing recovery operation. Other prior art systems have required breaking open of the drill string, at the surface, to either recover recording means itself or gain access to the recording made while downhole.

Measurement-while-drilling resistivity sensors are generally transmitters and receivers of either the current (conduction) type or induction type. Current type sensors include electrodes which are mounted on the surface of the sub for injecting and receiving current directly into and from the drilling mud and formation immediately adjacent to the sub. Induction type sensors include antenna coils on the surface of the sub for inducing and detecting currents into and from the surrounding drilling fluid and formation.

SUMMARY OF THE INVENTION

The present invention provides a method and apparatus for communicating with a measurement-while-drilling sub when the downhole equipment is at the surface and without the need of special connections through a bore or port in the sub. The present invention eliminates this additional port providing a safer, more reliable and easily operated system.

The present invention employs either electrodes or antenna coils to provide an electrical connection between data accumulation and storage circuits within the instrument sub and a data storage and processing device at the surface. The present invention connects or couples a surface deployed transmitter and receiver with the measurement-while-drilling resistivity sensor receiver and transmitter, respectively, preferably while the instrument sub is at the surface, for example during changing of the drilling bit. The surface deployed transmitter and receiver coupled to the sub circuits have the capability of sending operating commands to the measurement-while-drilling sub and receiving from the sub data collected while the sub was downhole. The circuits within the measurement-while-drilling tool must permit data stored within the sub to be transmitted through the electrode/antenna by temporarily disconnecting or blocking the electrode/antenna from its normal operating circuitry (or limiting such operation) to allow transmittal of the stored data. For example, the surface equipment may activate a switching mechanism to temporarily permit the resistivity device to function as a data transmitting system instead of a resistivity measuring (data accumulation) system.

BRIEF DESCRIPTION OF THE DRAWINGS

An embodiment of the present invention will now be described by way of example with reference to the accompanying drawing in which:

The single FIGURE shows a schematic section through a typical instrument sub of a downhole assembly at the surface and coupled to communication equipment in accordance with the present invention.

DETAILED DESCRIPTION OF THE PRESENT INVENTION

The single FIGURE schematically illustrates the present invention as it would be used in conjunction with a known downhole measurement-while-drilling instrumentation package. The equipment sub 10 is formed of high strength steel and has an axial bore 12 and an annular cavity 14 in which are placed a transmitter 16, a receiver 18, an electrode/antenna array 20 and a data storage 22. It should be here noted that the present invention will apply to any type of downhole equipment having a transmitter and a receiver operating at any frequency with the primary purpose of gathering borehole information. If the equipment is an electrical sensor, then it can be of a conductive or inductive type, and if it is, then, the conductive type requires electrodes and the inductive type requires antenna. The electrode/antenna array 20 is accordingly mounted at or on the sub's surface with either a single array for transmitting and receiving or with separate sections for transmitting and receiving. It should be noted that the present invention would also apply to acoustical equipment in the sonic range or any other type of measuring equipment operating in any frequency range with appropriate transmitting and receiving means mounted on the sub.

The operation of the measurement-while-drilling equipment is quite conventional with the information being gathered while the equipment is operating downhole and, in appropriate cases, only that data which is necessary to the boring operation being transmitted to the surface. The remaining information, such as strata configurations, would be placed into the storage for readout at a subsequent time. The downhole equipment could also be a system which would only record while downhole, with all data being recovered when the instrument sub is at the surface.

A surface communicator shown generally at 24 includes a transmitter 26, a receiver 28, and surface circuits 30 for data acquisition and system control. The surface communicator 24 must be compatible with the downhole equipment so that if the downhole equipment is of the inductive type, the surface equipment would likewise be of the inductive type. The transmitter 26 and receiver 28 of the communicator 24, for the inductive example, would be placed within transmitting range of the equipment sub 10 when the sub is at the surface, for example when the downhole equipment has been returned to the surface for bit replacement. In a conduction or current type system, there would have to be electrical contact between the electrodes as shown in the drawing. While the equipment sub is at the surface, and without being detached from the drill string or without the sub 10 being especially penetrated, the surface communicator 24 is brought to a position where the electrode/antenna of the transmitter 26 and receiver 28 can contact or be coupled to the receiver and transmitter electrode/antenna array 20 of the equipment sub 10. The surface equipment would then instruct the downhole equipment by the transmitter 26 sending instructions through array 20 and the receiver 18 for the data storage 22 to read out and transmit the stored information through the transmitter 16 and the array 20, the information being received by receiver 28 and sent to the circuits 30 where the data will be stored and/or processed accordingly. Once the data transmission has been completed, it is possible to either reprogram or instruct the downhole equipment by transmitting the appropriate information from the surface circuits 30 through the transmitter 26 to the array 20, the receiver 18 and into the data storage 22. The type of information that could be stored would include instructions for the data measuring/acquisition system of the sub 10 regarding anticipated drilling speed and direction or perhaps an expected profile of the geology of the area being bored so as to enable a comparison between the actual and the predicted geology. Also, selections from a menu of measurements that can be made could be loaded into data storage 22.

An alternate embodiment of the present invention would include a sonde mounted within the bore of a sub by appropriate means, such as spider web brackets. The sonde would include data storage and resistivity sensor electronics with the bore mounted sensor electronics connected to sub mounted sensor antenna means. The operation would be the same as described above with compatible surface equipment being coupled to the sensor antenna means to transmit instructions and receive data collected from downhole.

The present invention could also be used in recovering data in any instance where data is collected and stored in a sealed container, and it is desirous to maintain the sealed condition of the container. For example, recovering flow rate data from a pipeline by the present invention would avoid downtime and possible environmentally damaging spills. Other examples would include recovering data concerning activity within a nuclear cell or temperature/pressure conditions within a container housing hazardous materials.

The above-described apparatus normally operate in the radio frequency range. The present invention could also be used with sonic equipment by substitution of appropriate sensors.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. A method for communicating between surface equipment and a downhole measurement-while-drilling assembly when said assembly is at the surface, wherein said assembly includes at least one sensing means for measuring a downhole parameter, a downhole transmitter, a downhole receiver and information storage means, said downhole transmitter and said downhole receiver being connected between said sensing means and said information storage means, said sensing means operable in both a normal sensing mode and in a communication mode, and wherein said surface equipment includes communicating means, a surface transmitter, a surface receiver and data acquisition means, said surface transmitter and said surface receiver connected between said data acquisition means and said communicating means, comprising the steps of:

placing within communicating range of said downhole sensing means compatible communicating means of said surface equipment; and communicating directly between said surface equipment and said downhole assembly by communicating from said data acquisition means of said surface equipment through said surface transmitter and said communicating means to said information storage means through said downhole equipment sensing means and said downhole receiver or from said information storage means through said downhole transmitter and said downhole equipment sensing means to said data acquisition means through said surface equipment communicating means and said surface receiver.

2. A method according to claim 1 further comprising the step of:

transmitting from said surface equipment to said downhole equipment instructions for the information storage means to transmit data contained therein to said data acquisition means.

3. A method according to claim 1 further comprising the step of:

transmitting from said surface equipment to said downhole equipment instructions to be stored in said information storage means pertaining to further sensing to be performed by said at least one sensing means in a downhole environment.

4. A method according to claim 1 wherein said sensing and communicating means are electrodes and said step of bringing said sensing and communicating means within communicating range comprises making electrical contact.

5. A method according to claim 1 wherein said sensing and communicating means are antennas.

6. A method according to claim 1 wherein said downhole transmitter and said downhole receiver operate using sonic waves.

7. A method according to claim 1 wherein said downhole transmitter and said downhole receiver operate using electromagnetic waves.

8. A method according to claim 1 wherein said downhole measurement-while-drilling assembly remains closed during said communicating.

* * * * *